United States Patent [19]

Rossi et al.

[11] Patent Number: 4,826,615

[45] Date of Patent: May 2, 1989

[54] LUBRICATING OIL COMPOSITION CONTAINING DUAL ADDITIVE COMBINATION FOR LOW TEMPERATURE VISCOSITY IMPROVEMENT (PTF-004)

[75] Inventors: Albert Rossi, Warren; John P. Szykowski, Edison, both of N.J.; Robert D. Tack, Abingdon, United Kingdom

[73] Assignee: Exxon Chemical Patents Inc., Linden, N.J.

[21] Appl. No.: 231,531

[22] Filed: Aug. 10, 1988

Related U.S. Application Data

[63] Continuation of Ser. No. 742,576, Jun. 7, 1985, abandoned.

[51] Int. Cl.[4] ..... C10M 145/00; C10M 145/14

[52] U.S. Cl. ..... 252/56 R; 252/52 A

[58] Field of Search ..... 252/56 R, 52 A

[56] References Cited

U.S. PATENT DOCUMENTS

| | | | |
|---|---|---|---|
| 2,719,125 | 9/1955 | Roberts | 252/46.7 |
| 2,719,126 | 9/1955 | Fields et al. | 252/47 |
| 2,892,793 | 6/1959 | Stewart et al. | 252/56 R |
| 3,004,917 | 10/1961 | Fefer | 252/33.4 |
| 3,087,932 | 4/1963 | Little | 252/47 |
| 3,124,531 | 3/1964 | Wetzel, Jr. et al. | 252/52 A |
| 3,184,413 | 5/1965 | Furey et al. | 252/56 R |
| 3,236,771 | 2/1966 | Matson | 252/32.7 |
| 3,390,089 | 6/1968 | Tirtiaux et al. | 252/56 R |
| 3,442,808 | 5/1969 | Traise et al. | 252/51.5 A |
| 3,589,923 | 6/1971 | Stein | 252/52 A |
| 3,702,300 | 11/1972 | Coleman | 252/51.5 |
| 3,762,888 | 10/1973 | Kober et al. | 44/62 |
| 3,821,236 | 6/1974 | Ripple | 252/47 |
| 3,904,537 | 9/1975 | Ripple | 252/47 |
| 3,919,097 | 11/1975 | Park | 252/52 A |
| 3,961,916 | 6/1976 | Ilnyckyj et al. | 44/62 |
| 3,965,017 | 6/1976 | Burnop et al. | 252/52 A |
| 3,966,625 | 6/1976 | Tanizaki et al. | 252/52 A |
| 4,031,023 | 6/1977 | Musser et al. | 252/48.2 |
| 4,088,589 | 5/1978 | Rossi et al. | 252/56 R |
| 4,097,387 | 6/1978 | Caspari | 252/47 |
| 4,107,059 | 8/1978 | King et al. | 252/41 |
| 4,136,043 | 1/1979 | Davis | 252/47 |
| 4,151,069 | 4/1979 | Rossi | 208/33 |
| 4,188,299 | 2/1980 | Caspari | 252/46.7 |
| 4,193,882 | 3/1980 | Gemmill, Jr. | 252/391 |
| 4,229,311 | 10/1980 | Wenzel et al. | 252/50 |
| 4,240,916 | 12/1980 | Rossi | 252/56 R |
| 4,245,004 | 1/1981 | Login et al. | 252/52 A |
| 4,375,973 | 3/1983 | Rossi et al. | 44/62 |
| 4,464,182 | 8/1984 | Tack et al. | 44/62 |
| 4,470,914 | 9/1984 | Thir et al. | 252/52 A |
| 4,518,512 | 5/1985 | Kanamori | 252/52 A |

FOREIGN PATENT DOCUMENTS

| | | |
|---|---|---|
| 0061895 | 10/1982 | . |
| 0190869 | 8/1986 | . |
| 711364 | 6/1954 | United Kingdom . |

*Primary Examiner*—William R. Dixon, Jr.
*Assistant Examiner*—Jerry D. Johnson
*Attorney, Agent, or Firm*—R. A. Maggio

[57] ABSTRACT

There is disclosed a lubricating oil composition containing a dual additive combination for reducing the low temperature viscosity properties thereof. Such additive combination comprises a Component A, e.g., a polymethacrylate or esterified styrene/maleic anhydride copolymer and a Component B, e.g., sorbitan tristearate.

12 Claims, No Drawings

LUBRICATING OIL COMPOSITION CONTAINING DUAL ADDITIVE COMBINATION FOR LOW TEMPERATURE VISCOSITY IMPROVEMENT (PTF-004)

This is a continuation of application Ser. No. 742,576, filed June 7, 1985, abandoned.

BACKGROUND OF THE INVENTION

The present invention relates to lubricating oil compositions, such as automatic transmission fluids (ATF), containing a dual additive combination of two components to impart low temperature, low viscosity, and shear stability to the formulations containing the same.

Automatic transmission fluids typically are formulated to exhibit the proper viscosity at both high and low temperatures. Thus, at normal operating temperatures (85° to 120° C.), automatic transmission fluids must have a sufficiently high viscosity to prevent excessive leakage in the control and hydraulic systems. The fluid is subjected to shearing action by the transmission and must be shear stable in order to retain the advantages of this viscosity at elevated temperatures. On the other hand, automatic transmission fluids must also exhibit proper fluidity at low temperatures in order to insure proper functioning of pumps, prevent "burning" of clutch plates, and to allow free flow of fluid at temperatures of −30° C. and lower. Thus, low viscosity favors high efficiency in converters, and operation at low temperatures will be sluggish or fail when viscosity is excessively high.

The property of a fluid to resist changes in viscosity due to changes in temperature can be expressed as the "viscosity index" (VI); an emperical unitless number. The higher the viscosity index of an oil, the less its viscosity changes with changes in temperature. The demands placed on automatic transmission fluids make an oil of high viscosity index highly desirable.

Accordingly, additives have been developed to increase the viscosity index of the lubricant and thus extend the versatility and lubricating quantities of the lubricant at both high and low service temperatures. However, not only are the viscosity index properties especially important to automatic transmission fluids, but so also are the thickening effects of viscosity index improving agents upon the lubricant base.

More specifically, one of the stringent requirements for automatic transmission fluids is the relatively narrow limit of viscosity values. For example, a DEXRON® II specification for automatic transmission fluids has strict requirements in respect to low temperature viscosity characteristics and places a maximum viscosity limit of about 500,000 centipoises (cps) at −40° C. Such low temperature viscosity requirements must be achieved while simultaneously meeting high temperature viscosity requirements. Accordingly, many viscosity index improving agents conventionally added to automatic transmission fluids are associated with both low and high temperature effects. The low temperature viscosity effect is believed to result from interaction of the viscosity index improver with wax typically present in lubricants. Such interaction causes an initial decrease in low temperature viscosity at low level amounts of the viscosity index improver while simultaneously thickening the lubricant at more elevated temperatures. However, because there are limited amounts of wax present in conventional lubricants, increasing the amount of viscosity index improver beyond certain concentrations eventually exceeds the useful wax interactive amount, and the low temperature viscosity actually begins to increase. The result is that limits are placed on the amount of viscosity index improver concentration which can be added to achieve both low and high temperature viscosity benefits. Other materials are available which affect primarily only the low temperature viscosity properties such as pour point depressants. Pour point depressants also interact with wax to cause an initial decrease in low temperature viscosity. However, the effectiveness of such materials is also limited by the amount of wax present in the fluid for the same reasons discussed above in connection with the high and low temperature viscosity improving agents.

Accordingly, the search has continued for alternate ways to achieve low temperature viscosity requirements thereby permitting more flexibility in achieving both low and high temperature viscosity properties. The present invention is a result of this search.

U.S. Pat. No. 3,702,300 discloses multifunctional additives for lubricant compositions which are carboxy containing interpolymers in which many of the carboxy groups are esterified and the remaining carboxy groups are neutralized by reaction with polyamino compounds. Suitable carboxy containing polymers disclosed include interpolymers of maleic anhydride and styrene (Col. 4, Lines 32 et seq.). The additives are employed to impart anti-sludge properties and desirable viscosity properties to lubricants, particularly automatic transmission fluids (Col. 10, Lines 1 et seq.). Thus, this patent discloses a conventional viscosity index improver but does not disclose its combination with the materials of Component B as described herein.

U.S. Pat. No. 4,240,916 is directed to oil soluble copolymers of 1-olefins and maleic anhydride and esters thereof and their use as pour point depressants in lubricating oils. However, styrene is not disclosed as a suitable 1-olefin. Similar copolymers are disclosed in U.S. Pat. No. 4,151,069 as dewaxing aids for lubricating oils.

U.S. Pat. No. 4,229,311 discloses a method for making polymer in oil solutions useful for improving the viscosity-temperature relationship and low temperature properties of a lubricating oil. In accordance with said method, a methacrylic acid ester of a $C_8$ to $C_{10}$ alcohol is polymerized onto a $C_2$ to $C_4$ olefin polymer in an oil solution of the polyolefin and ester monomers. Additional polyolefin is added to the solution and a nitrogen containing heterocyclic compound is graft copolymerized onto the resulting mixed backbone methacrylate and olefin copolymer. Alternatively, the methacrylate monomer can be graft co-polymerized onto the olefin polymer to form a backbone polymer onto which the heterocyclic compound is graft copolymerized.

A number of patents disclose additive combinations for middle distillate fuels which are distinct from lubricating oils but are included herein for background purposes.

Thus, U.S. Pat. No. 3,762,888 discloses the combination of a pour point depressant for fuel oils in combination with auxiliary flow improving compounds. The pour point depressant can be an ethylene polymer, a hydrogenated olefin polymer, a $C_{10}$ to $C_{18}$ olefin polymer, a halogenated ethylene polymer, or an ethylene copolymer wherein the comonomer can be a vinyl ester such as vinyl acetate, an ethylenically unsaturated ester such as methylacrylate or methylmethacrylate, fumarates and maleates. The auxiliary flow improving compound contains at least one straight chain polymethylene segment containing a bulky substituent which may be polar or nonpolar. Representative auxiliary flow improvers disclosed include sorbitan monostearate, sorbitan tristearate, polyoxyethylene (8) stearate, polyoxyethylene (20) sorbitan tristearate and the like.

U.S. Pat. No. 3,961,916 discloses a dual functioning flow improving composition, for middle distillate fuel oils, containing a wax growth arrestor and a nucleating agent. The wax growth arrestor can be an ethylene vinyl acetate copolymer and the nucleator ca be a different ethylene vinyl acetate copolymer, the nucleator differing from the growth arrestor by the proportion of the vinyl acetate present therein and/or the molecular weight of the polymer. The combination imparts improvements in the filterability of middle distillate fuels.

U.S. Pat. No. 4,375,973 discloses a three component additive combination for improving cold flow properties of middle distillate fuels. These three components are: (a) a distillate flow improver which is an ethylene containing polymer, typically a copolymer of ethylene with unsaturated esters, e.g., vinyl acetate; (b) a hydrocarbon polymer of $C_2$ to $C_{30}$ olefin of number average molecular weight of $10^3$ to $10^6$ or a derivatized version thereof, for example, copolymers of ethylene and propylene, or polyisobutylene, which are used as lubricating oil viscosity index improvers; and (c) a polar oil soluble compound which includes amides, salts, carboxylates, sulfonates, sulfates, phosphates, phenates and borates, having hydrocarbon solubilizing groups, for example, salts and amides of polycarboxylic acid such as phthalic anhydride reacted with hydrogenated secondary tallow amine.

U.S. Pat. No. 4,464,182 is directed to a narrow boiling distillate fuel oil containing certain polyalkylene esters, ethers, ester/ethers or mixtures thereof. Such additives have at least two $C_{10}$ to $C_{30}$ linear saturated alkyl groups and a polyoxyalkylene glycol derived moiety of a molecular weight of 100 to 5,000 present in the structure. The alkyl group of the polyoxyalkylene glycol contains from 1 to 4 carbons. In broad boiling distillate fuels the ester, ether, or ester/ether additives are typically employed in conjunction with other flow improver additives. Suitable additional flow improvers as disclosed include ethylene copolymers wherein the comonomer is an unsaturated mono- or di-ester such as vinyl acetate, methyl methacrylate and various fumurates.

British Patent Specification No. 711,364 is directed to a diesel fuel containing a small amount of polyethylene ether, or epoxy, derivative of a carboxylic acid ester of a polyhydric alcohol.

None of the above discussed patents disclose the particular additive combination as a low temperature viscosity modifier for lubricating oil compositions.

SUMMARY OF THE INVENTION

The present invention resides in the discovery that the combination of two additive components, designated Components A and B herein, for use in a lubricating oil composition, is effective to reduce the low temperature viscosity of the lubricating oil composition relative to the absence of one or both of said components. Such effect is believed to result from the combined interaction of said components with wax present in conventional lubricating oils. Such wax disadvantageously affects the low temperature viscosity properties of lubricating oils in the form of wax crystals by increasing the viscosity of said lubricating oils at such low temperatures.

The dual additive combination of the present invention achieves a reduction in low temperature viscosity of lubricating oils not otherwise achievable by either component thereof alone, and hence its effect is thought to be synergistic.

Accordingly, in one aspect of the present invention, there is provided a lubricating oil composition comprising a major amount of a mineral oil of lubricating viscosity and a minor amount of a dual additive combination comprising Components (A) or (B) effective to lower the viscosity of said composition at temperatures between about −20° and −40° C. relative to the absence of either of Components (A) or (B), wherein:

(1) Component A comprises of at least one member selected from the group consisting of:

(i) a polymeric product characterized by a number average molecular weight of from about 25,000 to about 70,000 and of the type derived from the random polymerization of a reaction mixture comprised of at least 90 mole % of at least one ester monomer represented by the structural formula:

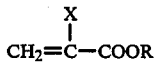

(I)

wherein X can represent hydrogen or methyl, and R represents an aliphatic hydrocarbyl group containing from about 1 to about 24 carbon atoms, with the proviso that the average number of carbon atoms in the hydrocarbyl group constituting R within said polymeric product is from about 8 to about 18; and (ii) an esterified polymeric product derived from the esterification of an interpolymer of the type derived from the reaction of a monomer mixture consisting essentially of (a) styrene and (b) a carboxyl containing monomer anhydride represented by the structural formula:

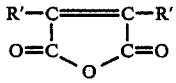

(II)

wherein each R′ independently can represent hydrogen or methyl; the molar ratio of styrene to carboxyl containing monomer in said reaction mixture being from about 3:1 to about 1:1 and said unesterified interpolymer being characterized by a number average molecular weight of from about 25,000 to about 70,000; said esterification being characterized by that resulting from the reaction of at least 50 mole % of the carboxyl groups present on said unesterified interpolymer with a reaction mixture comprised of at least one aliphatic monohydric alcohol containing from about 1 to about 24 carbon atoms; and (2) Component B comprises at least one member selected from the group consisting of:

(i) sorbitan monoesters, sorbitan diesters, sorbitan triesters, and mixtures thereof, which esters are derived from $C_{10}$ to $C_{30}$ straight chain saturated fatty acids;

(ii) polyoxymethylene or polyoxyethylene: esters, ethers or ether/alcohols, or ester/ether mixtures derived from $C_{10}$ to $C_{30}$ straight chain saturated fatty acids, $C_{10}$ to $C_{30}$ saturated aliphatic alcohols, or mixtures of said fatty acids or alcohols, respectively; said polyoxymethylene segments thereof having a number average molecular weight of from about 80 to about 4,000, and said polyoxyethylene segments thereof having a number average molecular weight of from about 100 to about 5,000; and (iii) polyoxymethylene or polyoxyethylene ethers of sorbitan monoesters, sorbitan diesters, sorbitan triesters or mixtures thereof, said sorbitan esters being derived from $C_{10}$ to $C_{30}$ straight chain saturated fatty acids, and said polyoxymethylene and polyoxyethylene segments thereof having number average molecular weights as described in connection with Component B-ii.

DESCRIPTION OF PREFERRED EMBODIMENTS

The dual additive combination of the present invention comprises a mixture of at least two distinct compounds, referred to herein as Components A and B.

Component A is composed of two distinct classes of polymers and/or copolymers. The first of these classes, referred to herein as Component A-i is comprised of polymers or random copolymers of the type derived from a polymerization reaction mixture containing typically at least 90 mole %, preferably at least 95 mole % of monomers selected from the group consisting of alkyl acrylates, alkylmethacrylates and mixtures thereof. The remainder of the monomers typically constitute the nitrogen containing monomers described hereinafter.

More specifically, the monomers from which the polymers or copolymers of Component A-i can be derived may be represented by the structural formula:

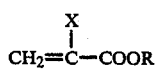

(I)

wherein X can represent a hydrogen or methyl, and R represents an aliphatic, preferably saturated aliphatic (e.g., alkyl), hydrocarbyl group containing from about 1 to about 24, preferably from about 5 to about 20, and most preferably from about 8 to about 18 (e.g., 12 to 15) carbon atoms, provided that the average number of carbon atoms per molecule in the hydrocarbyl groups constituting R, is between about 8 and 18, preferably between about 12 and 16, and most preferably between about 12 and about 15.

The ester monomers of structural formula I may be prepared by esterification of acrylic or methacrylic acid with one or more appropriate alcohols in accordance with methods well known in the art.

The alcohols used in preparing such ester monomers contain the aforedescribed carbon numbers and are aliphatic. Primary monohydric alcohols are preferred over secondary and tertiary alcohols. The alcohols are preferably saturated, and some degree of unsaturation is permissible when mixtures of alcohols are employed, e.g., less than about 2 mole % of the alcohols in the mixture can be unsaturated. Straight chain or lightly branched alcohols are preferred over highly branched alcohols. When mixtures of alcohols are employed, those containing from $C_1$ to $C_{24}$ carbon atoms can be employed in such proportions that the average number of carbons in the alcohol residue per monomer molecule is between about 8 and about 18. Furthermore, when a mixture of alcohols is employed, it is preferred that at least 50 mole %, most preferably at least 75 mole % of the alcohols present in such mixture contain between 8 and 18 carbon atoms.

When a single alcohol is used to make the ester monomer, those containing between about 8 and 18 carbon atoms may be used.

Representative acrylate and/or methacrylate monomers suitable for use in preparing Conponent A-i include, subject to the above carbon number average restrictions, methyl acrylate, propyl methacrylate, hexyl acrylate, octyl acrylate, decyl acrylate, dodecyl acrylate, hexyl methacrylate, octyl methacrylate, decyl methacrylate, dodecyl methacrylate, tetradecyl acrylate, hexadecyl acrylate (cetyl acrylate), octadecyl acrylate, tetradecyl methacrylate, hexadecyl acrylate, octadecyl methacrylate, tridecyl acrylate, tetradecyl methacrylate, pentadecyl acrylate, and hexadecyl acrylate.

Preferred monomer mixtures of alkyl acrylates or methacrylates are those containing $C_{12}$ to $C_{18}$ alkyl esters having a carbon number average of about 13 in the mixture for the alkyl portion of the ester.

Preferably, all the alkyl esters in a given polymer will have the same acid moiety, i.e., the mixture of alkyl esters will be a mixture of alkyl acrylates or alkyl methacrylates.

The minimum number of carbon atoms of the R substituent of the ester monomer is typically selected to avoid insolubility of the polymer in the lubricating oil, and the maximum number of carbon atoms therein is selected to avoid crystallization of the polymer out of the lubricating oil at low temperatures.

Minor amounts of conventional nitrogen containing ethylenically unsaturated monomers can also be incorporated into the mixture of acrylate or methacrylate monomers used to form Component A-i in order to obtain sludge dispersancy. Such nitrogenous monomers include, for example, N,N-dimethylaminoethyl acrylate, N,N-dimethylaminoethylacrylamide, N,N-dimethylaminoethyl methacrylate or methacrylamide, and 4-vinyl pyridine. Preferred nitrogen containing monomers are those derived from the reaction of acrylic or methacrylic acid with beta-hydroxy $C_1$ to $C_3$ alkyl amines, such as beta-hydroxy ethylamine, and derivatives thereof and/or beta-amino $C_1$ to $C_5$ alkylamines, such as beta-aminoethylamine and derivatives thereof. In the latter instance, acrylamide or methacrylamide monomers will result. The amount of nitrogenous monomer is sufficient to impart dispersancy to the resulting copolymer, and is generally an amount which will give a copolymer containing about 0.2 to about 2, preferably about 0.5 to about 1% by weight of nitrogen.

The polymers or copolymers of Component A-i are characterized by a number average molecular weight which can vary from about 25,000 to about 70,000, preferably from about 35,000 to about 60,000, and most preferably from about 35,000 to about 50,000.

Number average molecular weight is determined by membrane osmometry.

The polymers and copolymers of Component A-i can be prepared by conventional free radical polymerization techniques, starting with a mixture of all of the constituent monomers which is essentially free of polymer. Thus, the polymers are random copolymers and are not graft or block copolymers. Conventional free radical polymerization catalysts, such as azobis-(isobutyronitrile), tert butyl hydroperoxide, and benzoylperoxide, can be used.

Polymerization of the ester monomers is preferably carried out in an inert hydrocarbon solvent, such as hexane or heptane. Polymerization is carried out in an oxygen-free reactor. The desired atmosphere can be maintained by carrying out the polymerization in a nitrogen atmosphere as is known in the art. Temperatures of about 65° to about 120° C., depending on the choice of initiator, can be used. Polymerization is carried out at either atmospheric or super-atmospheric pressure and on either a batch or a continuous basis. Polymerization can be stopped when the desired degree of polymerization is reached by known techniques, such as adding inhibitors to the reaction mixture, or can be allowed to go to completion.

The second class of polymeric materials suitable for use as Component A, and referred to herein as Component A-ii, include esterified interpolymers of (a) styrene and (b) at least one monovinyl dicarboxylic anhydride monomer represented by the structural formula:

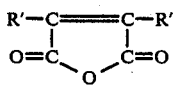

(II)

wherein each R' independently can represent hydrogen or methyl. When the monomer represented by formula II is incorporated into the interpolymer along with styrene, the carboxyl groups are esterified with a monohydric alcohol, preferably an alcohol mixture as described hereinafter. Accordingly, the monomer moiety, derived from the monomer of formula II, when present in the interpolymer after esterification can be represented as follows:

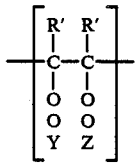

(III)

wherein Y represents hydrogen or Z', and Z and Z' independently represent an aliphatic, preferably saturated aliphatic (e.g., alkyl) hydrocarbyl group containing from about 1 to about 24, preferably from about 10 to about 18, and most preferably from about 12 to about 18 carbon atoms. The hydrocarbyl groups constituting Z or Z' represent the hydrocarbyl residue of the alcohol(s) from which the same are prepared, which alcohols can be branched, preferably straight chain, most preferably straight chain alkyl. While monoesters can be formed wherein Z' is hydrogen, it is preferred to esterify both carboxy groups of the carboxy containing monomer moiety.

Anhydride monomers from which the unesterified interpolymers can be prepared include maleic, and itaconic. The most preferred esterified monomer moieties are diester maleates.

Preferred esterified interpolymers of Component A-ii are those characterized by a particular carbon number distribution in the alcohol moiety from which the Z and Z' groups are derived. For example, it is preferred to react the unesterified interpolymer with a mixture of alcohols wherein the molar proportion, within said mixture, of alcohols containing from about $C_1$ to about $C_7$, preferably $C_3$ to about $C_5$ carbon atoms, can vary typically from about 0 to about 30 (e.g., 10 to 30), preferably from about 5 to about 20, and most preferably from about 10 to about 15 mole %, based on the total number of moles of alcohols in said mixture; and correspondingly the molar portion, within said mixture, of alcohols containing from about $C_8$ to about $C_{24}$, preferably from about $C_{10}$ to about $C_{18}$, and most preferably from about $C_{12}$ to about $C_{15}$, can vary correspondingly from about 100 to about 70 (e.g., 90 to 70), preferably from about 95 to about 80, and most preferably from about 90 to about 85 mole % of the alcohols in said mixture. Such alcohol mixtures typically give rise to both high and low molecular weight esters moieties within the interpolymer typically in the same ratio as in the alcohol mixture from which they are derived.

In selecting the alcohols employed to esterify the carboxy containing moieties of the interpolymer, primary alcohols are preferred over secondary and tertiary alcohols. The alcohols are preferably saturated, although some degree of unsaturation is permitted, e.g., less than about 2 mole % of the alcohols in the alcohol mixture can be unsaturated. Straight chain alcohols are preferred over branched alcohols.

Representative examples of suitable alcohols include methanol, ethanol, n-propanol, isopropanol, n-butanol, sec-butanol, isobutanol, n-pentanol, neopentanol, n-hexanol, cyclohexanol, cyclopentanol, octanol, isooctanol, decanol, dodecanol, n-tricosanol, n-tetracosanol, tridecanol, and mixtures thereof.

Optionally, but preferably, nitrogen can be incorporated into the interpolymer of Component A-ii in accordance conventional procedures in an amount typically from about 0.1 to about 0.7, and preferbly from about 0.15 to about 0.4% nitrogen, by weight, based on the esterified interpolymer weight. Typically this is achieved by conducting the esterification reaction of the interpolymer in a manner sufficient to leave a portion of the carboxyl grioups unesterified. Such residual free carboxyl groups can then be reacted with a nitrogen containing compound such as mono or polyamines, as well as hydroxy amines such as gamma-hydroxy $C_1$ to $C_5$ alkyl amines (e.g., beta-hydroxy ethylamine).

Nitrogen containing compound suitable for reaction with the carboxyl groups of the acid moiety of the copolymer include primary, secondary, or tertiary, organic amines as well as mixtures thereof. Such amines can form ammonium salts, amine salts, and/or imides by reaction with the carboxyl group.

The hydrocarbyl groups of the nitrogen compounds may be branched, preferably straight chain, preferably saturated, aliphatic, cycloaliphatic, aryl or alkaryl, and typically will contain from about $C_2$ to about $C_{40}$, preferably $C_{10}$ to about $C_{24}$ carbon atoms.

Representative examples of primary amines include n-dodecyl amine, n-tridecyl amine, $C_{13}$ Oxo amine, coco amine, tallow amine, and behenyl amine. Examples of secondary amines include methyl-lauryl amine, dodecyl-octyl amine, coco-methyl amine, methyl-behenyl amine and di hydrogenated tallow amine. Examples of tertiary amines include cocdiethyl amine, cycloheyldiethyl amine, coco-dimethyl amine and methyl certyl stearyl amine, methyl-ethyl-coco amine, methyl-cetylstearyl amine, etc.

Amine mixtures may also be used and many amines derived from natural materials are mixtures. Thus, coco amines derived from coconut oil are mixtures of primary amines with straight chain alkyl groups ranging from $C_8$ to $C_{18}$. Another example is hydrogenated tallow amine, derived from tallow acids, which amine contains a mixture of $C_{14}$ to $C_{18}$ straight chain alkyl groups.

Preferably, polyamines are employed which contain at least one primary or secondary amino group, and most preferably in addition thereto at least one tertiary amino group, including tertiary heterocyclic amino groups. The polyamines may be aromatic or aliphatic, preferably heterocyclic, such as aminoalkyl-substituted morpholines, piperazines, pyridines, quinolines, pyrroles, and the like. The alkyl groups of the substituted heterocyclics typically contain from about 4 to about 20, and preferably from about 4 to about 12 carbon atoms.

While in some instances the polyamino compounds can contain 6 or more amino groups, they typically contain one primary amino group and one or two tertiary amino groups.

When the polyamino compound reacts with the free carboxyl groups of the monomer moiety containing the same, the linkage formed can be an amide, imide, or amidine.

Representative examples of suitable polyamino compounds are disclosed in U.S. Pat. No. 3,702,300 at Columns 3 and 4, the disclosure of which is incorporated by reference. Such polyamino compounds include dimethyl-amino-ethylamine, dibutyl-amino-ethylamine, 3-dimethyl-amino-1-propylamine, bis-(dimethylamino)-propylamine, N,N-dimethyl-p-phenyklene diamine, piperidyl-ethylamine, 1-aminobutyl imidazole, and mixtures thereof.

The most preferred polyamino compounds are the N-amino alkyl morpholines wherein the alkyl group contains from 1 to about 6 carbon atoms, such as N-aminopropyl morpholine.

Typically from about 2 to about 50, preferably from about 5 to about 25, and most preferably from about 5 to about 15 mole % of the free carboxyl groups initially present on the interpolymer are neutralized and/or reacted with the nitrogen containing compound. Consequently, the esterification reaction is conducted to leave the appropriate amount of residual carboxyl groups for reaction with the nitrogen compound.

Absent the use of a nitrogen containing compound, the degree of esterification of the copolymer typically will vary from 50 to about 100, preferably from about 75 to about 100, and most preferably from about 90 to about 100 mole % of the available carboxyl groups initially present in the copolymer.

Similarly, when a nitrogen compound is employed, the degree of esterification typically will vary from about 50 to about 98, preferably from about 75 to about 95, and most preferably from about 85 to about 95 mole% of the available carboxyl groups initially present.

In forming the unesterified intermediate interpolymer, the molar ratio of styrene to unsaturated carboxy containing monomer typically can vary from about 3:1 to about 1:1, preferably from about 2:1, to about 1:1, and most preferably from about 1.5:1 to about 1:1.

Most preferably equal molar amounts of styrene and unsaturated carboxy containing monomer (e.g., maleic anhydride) are employed. In addition, minor amounts of other miscellaneous interpolymerizable comonomers can be included in the reaction mixture. By minor amount is meant typically less than about 1, preferably less than about 0.3 mole of miscellaneous monomers per mole of styrene or carboxy containing monomer, whichever of the primary monomers is employed in lower amounts relative to the other.

Representative examples of suitable miscellaneous interpolymerizable comonomers include vinyl monomers such as vinyl acetate, acrylonitrile, methacrylate, methylmethacrylate, acrylic acid, vinyl chloride, isobutene, and the like.

Various methods of interpolymerizing styrene and the carboxyl containing monomers are known in the art and need not be discussed in detail herein.

The interpolymerization reaction is typically conducted to produce an unesterified interpolymer having a number average molecular weight from about 25,000 to about 70,000, preferably from about 40,000 to about 60,000, as determined by membrane osmometry.

The resulting interpolymer is then esterified with an alcohol or alcohol mixture.

The esterification can be accomplished simply by heating the carboxy-containing interpolymer and the alcohol or alcohol mixture under conditions typically for effective esterification. Such conditions usually include, for example, a temperature of at least about 80° C., preferably from about 100° C. to about 150° C., provided that the temperature be below the decomposition point of the reaction mixture proceeds. Such condition may optionally include the use of an excess of the alcohol reactant so as to facilitate esterification, the use of a solvent or diluent such as mneral oil, toluene, xylene or the like, and the use of an esterification catalyst such as toluene sulfonic acid, sulfuric acid, phosphoric acid, or the like. These conditions and variations thereof are well known in the art.

When a nitrogen compound is sought to be incorporated into the polymer by neutralization and/or reaction of the unesterified carboxyl grops, such reaction is preferbly carried out at a temperature of at least about 80° C. often from about 100° C. to about 150° C., provided that the temperature does not exceed the decomposition point of the reaction mass. In most instances, the neutralization temperature is between about 105° C. and 130° C. A slight excess of the stoichiometric amount of the nitrogen compound is often desirable, so as to insure substantial completion of reaction, e.g., no more than about 2% of the carboxy radicals initially present in the interpolymer remained unreacted.

Component B of the dual additive combination of the present invention can be divided in three general classes, namely, (i) sorbitan mono-, di-, or tri-esters of $C_{10}$ to $C_{30}$ saturated straight chain fatty acids as well as mixtures thereof; (ii) polyoxymethylene or polyoxyethylene: esters, ethers or ether/alcohols, or ester/ether mixtures of $C_{10}$ to $C_{30}$: straight chain saturated fatty acids and/or saturated aliphatic, and most preferably saturated aliphatic straght chain monohydric, alcohols; and (iii) polyoxymethylene or polyoxyethylene ethers of sorbitan mono-, di-, or tri-esters of $C_{10}$ to $C_{30}$ straight chain saturated fatty acids as well as mixtures of said sorbitan esters.

Component B-i comprises at least one sorbitan ester. More specifically, Component B-i comprises a carboxylic acid ester of a partially dehydrated aliphatic hexitol (i.e., a hexitol anhydride), such as sorbitol and manitol. Partial dehydration converts the hexitol to an epoxide and/or inner ether type of compound having hydroxyl substituents and either one, or two (fused) mono-oxy, four to seven membered carbon-oxygen rings in its probable configuration.

Thus, an hydroxy containing monocyclic ether product produced by the partial dehydration of sorbitol through the removal one molecule of water is commonly referred to as a sorbitan; while an hydroxy containing dicyclic ether product produced by the removal of two molecules of water from sorbitol is commonly referred to as a sorbide. Sorbitan accordingly can constitute one, or a mixture of, hydroxy containing cyclic ethers; likewise with respect to sorbides. The hydroxyl groups attached to the cyclic ethers retain the reaction properties of an alcohol, one of which is that of reacting with a fatty acid to produce an ester.

Accordingly, representative configurations of the sorbitan esters suitable for use as Component B-i can be illustrated by the following structural formulas:

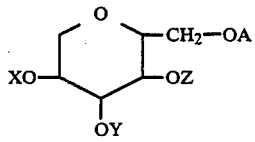

(IVa)

and

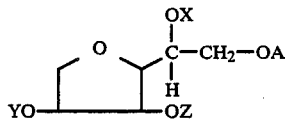

(IVb)

wherein A, X, Y, and Z independently can represent hydrogen or a long chain fatty acid residues containing from about 10 to about 30, preferably from about 12 to about 25, and most preferably from about 14 to about 18 carbon atoms, provided at least one of A, X, Y, or Z, on each of formulas IVa and IVb, is not hydrogen.

Likewise, a representative configuration of a sorbide ester can be illustrated by the following structural formula:

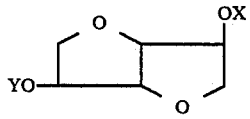

(IVc)

wherein X and Y are as described above in connection with formulas IVa and IVb, with at least one of X or Y being non-hydrogen.

The aforedescribed cyclic ether esters are commercially available under the trade name Spans®, which are identified by the nature of the fatty acid employed to make the ester. Conventionally, it is not common to distinguish between sorbide and sorbitan esters since the hexitol partial dehydration reaction typically results in a complex mixture of sorbitans and sorbides. Accordingly, for purposes of the present invention, reference herein to sorbitan is intended to include mixtures of sorbitans and sorbides.

Representative examples of suitable sorbitan esters include, sorbitan monolaurate (Span 20®), sorbitan monopalmitate (Span 40®), sorbitan monostearate (Span 60®), sorbitan tristearate (Span 65®), and mixtures thereof.

Component B-ii typically comprises at least one ester, ether or ether/alcohol, or ester/ether which can be represented by the structural formula:

$$R_2\text{-}(O\text{—}A)_n O\text{—}R_3 \qquad (V)$$

wherein (A) represents methylene or ethylene, n is a number which can vary typically from about 2 to about 100, preferably from about 3 to about 50, and most preferably from about 4 to about 13; and $R_2$ and $R_3$ independently may be selected from the group of hydrocarbyl radicals consisting of:

$$R_4\text{—} \qquad (IV)$$

$$R_4\text{—}\overset{O}{\overset{\|}{C}}\text{—} \qquad (VII)$$

and mixtures thereof; and wherein each $R_4$ independently is hydrogen or a straight chain alkyl hydrocarbyl group, containing typically from about 10 to about 30, preferably from about 12 to about 25, and most preferably from about 12 to about 22 carbons, provided at least one of said $R_4$ groups per molecule is alkyl, Accordingly, the moiety —O—A)$_n$O— in formula (V) represents the residue of a polymethylene glycol (PMG) or polyethylene glycol (PEG), segment having the number of repeating oxymethylene or oxyethylene units indicated by (n). Thus, the number average molecular weight of the polyoxymethylene segment can vary typically from about 80 to about 4,000, preferably from about 90 to about 1,000, and most preferably from about 100 to abut 600. The number average molecular weight of the polyoxyethylene segment can vary typically from about 100 to about 5,000, preferably from about 110 to about 2000, and most preferably from about 120 to about 700.

When $R_2$ and $R_3$ are alkyl as depicted by $R_4$ of formula (VI), Component B-ii constitutes a poly ether. In such instances, the $R_4$ moiety of formula VI is typically derived from a monohydric, primary alcohol. When $R_2$ or $R_3$ is hydrogen, Component B-ii constitutes an ether/alcohol. Representative examples of suitable poly ethers or ether/alcohols include:

PEG (10) dioctadecyl ether
PEG (20) ditridecy ether
PMG (8) dihexadecyl ether
PEG (12) didocosyl ether
PEG (10) octadecyl ether and mixtures thereof. The numbers in parentheses after PEG or PMG above indicate the number of repeating oxyalkylene groups per molecule in formula V.

When $R_2$ and $R_3$ represent the moiety depicted by the formula VII, Component B-ii constitutes an ester/ether. Representative examples of suitable compounds of this class include:

PEG (10) distearate
PMG (8) dilaurate
PEG (20) dipalmitate
PEG (10) dibehenate
PEG (6) distearate
PEG (5) dibehenate
PEG (14) dibehenate
PEG (14) behenate/sterate
PEG (5)(10)(14) dibehenate
PEG (5)(10)(14) behenate/stearate Component B-iii comprises at least one polyoxymethylene or polyoxyethylene derivative of hexitol anhydride (i.e. sorbitan) partial long chain fatty acid esters. Such materials are similar to Spans® with the exception that at least one oxy residue of a sorbitan hydroxyl group is linked to a polyoxymethylene or polyoxyethylene moiety represented by the respective structural formulas:

$$H\text{-}(O-CH_2-CH_2)_{n_1} \quad \text{(VIII)}$$

$$H\text{-}(O-CH_2)_{n_1} \quad \text{(IX)}$$

wherein $n_1$ can vary from about 3 to about 100, preferably from about 4 to about 50, and most preferably from about 5 to about 25. In addition, at least one, preferably two, most preferably 3, hydroxy groups of the sorbitan is reacted with the carboxyl groups of a $C_{10}$ to $C_{30}$ fatty acid to form the ester functional group. Suitable fatty acids are the same as described in connection with Component B-i above. Commercially, such materials are available under the trade name Tween ®. The polyoxyalkylene groups typically are derived from polymethylene glycol (PMG) and preferably polyethylene glycol (PEG).

Representative examples of polyoxyalkylene sorbitan fatty acid esters suitable for use in the present invention include:

Sorbitan distearate PEG (20)
Sorbitan tristearate PEG (20) (Tween 65 ®);
Sorbitan monopalmitate PEG (20) (Tween 40 ®);
Sorbitan monostearate PEG (20) (Tween 61 ®);
Sorbitan tristearate PMG (20)

Mixtures of any of the above can also be employed. The number in parentheses following PEG or PMG in the above list of compounds signifies the value of $n_1$ in the respective formulas (VIII) and (IX).

The method of preparation of the materials within the scope of Component B are well known in the art and need not be discussed in detail herein.

While mixtures of Components A-i and A-ii can be employed in combination with a single compound or mixture of compounds falling within the scope of Component B, it is preferred to employ either Component A-i or Component A-ii in combination with at least one comound of a single class of Components B-i to B-iii.

The amount of Component A employed in the base oil is selected in accordance with the low and high temperature viscosity index requirement sought to be imparted thereto. Accordingly, while any effective amount of Component A can be employed, it is contemplated that such effective amount constitute typically from about 0.7 to about 2.5, and preferably from about 0.9 to about 2.0%, by weight, based on the weight of the base oil and Component A.

Component B on the other hand, synergistically interacts with Component A to depress the low temperature viscosity (e.g. about −20° to about −40° C.) of the base oil containing Component A. Thus, the amount of Component B is related to the amount of Component A employed in the base oil. Accordingly, while any amount of Component B effective to lower the viscosity (cps) of the base oil containing Component A at a temperature between about −20° and −40° C., relative to the absence of Component B may be employed, it is contemplated that such effective amount be sufficient to achieve a weight ratio of Components A:B of typically from about 10:1 to about 50:1, preferably from about 15:1 to about 40:1, and most preferably from about 18:1 to about 25:1.

The base oil into which Components A and B are added is a mineral lubricating oil, which can benefit from the low temperature viscosity properties imparted thereto. Typically, low temperature viscosity is measured by a rotating disk viscometer such as the Brookfield viscometer, and is expressed in centipoise (cps).

More specifically, the lubricating oil base stocks used in the compositions of this invention are distillates derived from paraffinic, naphthenic, asphaltic, or mixed base crudes. The oils may be refined by conventional methods using acid, alkali, and/or clay or other agents such as aluminum chloride, or they may be extracted oils products, for example, by solvent extraction with solvents of the type of phenol, sulfur dioxide, furfural, dichlorodiethyl ether, nitrobenzene, crotonaldehyde, etc.

The lubricating oil base stock ordinarily has a viscosity of about 13 to about 25 centistokes at 40° C.

As is conventional in the art, lubricating oils do not include middle distillate fuels.

The lubricating oil base stock typically is adapted to perform a selected function by the incorporation of additives therein to form lubricating oil compositions.

One broad class of lubricating oil compositions suitable for use in conjunction with the dual additive combination of the present invention are power transmitting fluids, including automatic transmission fluids, hydraulic fluids, heavy duty hydraulic fluids, power steering fluids, tractor universal oils, and the like.

The benefits of the dual additive combination of the lpresent invention are particularly significant when employed in a lubricating oil adapted for use as an automatic transmission fluid.

Automatic transmission fluids (ATF) are compounded from a number of additives each useful for improving a chemical and/or physical property of the same. The additives are usually sold as a concentrate package in which mineral oil is present. The mineral lubricating oil will typically constitute from 40 to 60 weight percent of the package and typically is a refined hydrocarbon oil or a mixture of refined hydrocarbon oils selected according to the viscosity requirements of the particular ATF but typically would have a viscosity range of 13 to about 25 centistokes at 40° C. (ASTM D-2983). Suitable base oils include a wide variety of light hydrocarbon mineral oils, such as, naphthenic base, paraffin base, and mixtures thereof.

Additives present in such packages include viscosity improvers, corrosion inhibitors, oxidation inhibitors, friction modifers, dispersants, demulsifiers, anti-foaming agents, anti-wear agents, pour point depressants and seal swellants.

Since Component A also functionas as a viscosity modifier, there is no need to add additional viscosity modifiers, although additional viscosity modifiers can be employed including polyisobutylene, copolymers of ethylene and propylene, methylacrylate copolymers, co-polymers of an unsaturated dicarboxylic acid and vinyl compound and interpolymers of styrene and acrylic esters.

Corrosion inhibitors, also known as anti-corrosive agents reduce the degradation of the metallic parts contained by the ATF. Illustrative of corrosion inhibitors are zinc dialkyldithiophosphate, phosphosulfurized hydrocarbons and the products obtained by reaction of a phosphosulfurized hydrocarbon with an alkaline earth metal oxide or hydroxide, preferably in the presence of an alkylated phenol or of an alkylphenol thioester, and also preferably in the presence of carbon dioxide. Phoshosulfurized hydrocarbons are prepared by reacting a suitable hydrocarbon such as a terpene, a heavy petroleum fraction of a $C_2$ to $C_6$ olefin polymer such as polyisobutylene, with from 5 to 30 weight percent of a sulfide of phosphorous for ¼ to 15 hours, at a temperature in the range of 150° to 600° F. Neutralization of the phosphosulfurized hydrocarbon may be effected in the manner taught in U.S. Pat. No. 2,969,324.

Oxidation inhibitors reduce the tendency of mineral oils to deteriorate in service which deterioration is evidenced by the products of oxidation such as sludge and varnish-like deposits on the metal surfaces. Such oxidation inhibitors include alkaline earth metal salts of alkylphenol thioesters having preferably $C_5$ to $C_{12}$ alkyl side chains, e.g., calcium nonylphenol sulfide, barium t-octylphenol sulfide, zinc dialkyldithiophosphates, dioctylphenylamine, phenylalphanaphthylamine, phosphosulfurized or sulfurized hydrocarbons, etc.

Dispersants maintain oil insolubles, resulting from oxidation during use, in suspension in ATF thus preventing sludge flocculation and precipitation. Suitable depressants include high molecular weight alkyl succinates, the reaction product of oil-soluble polyisobutylene succinic anhydride with ethylene amines such as tetraethylene pentamine and borated salts thereof.

Pour point depressants lower the temperature at which the ATF will flow or can be poured. Such depressants are well known. Typical of those additives which usefully optimize the low temperature fluidity of the ATF are $C_8$–$C_{18}$ dialkylfumarate vinyl acetate copolymers, polymethacrylates ($C_{12}$ to $C_{18}$ alkyl), and wax naphthalene condensation products.

Foam control is provided by an anti-fomant of the polysiloxane type, e.g., silicone oil and polydimethyl siloxane.

Anti-wear agents, as their name implies, reduce wear of transmission parts. Representative of suitable anti-wear agents are zinc dialkyldithiophosphate, zinc diaryldithiophosphate and magnesium sulfonate.

Some of these numerous additives can provide a multiplicity of effects, e.g., a dispersant-oxidation inhibitor. This approach is well known and need not be further elaborated herein.

Seal swellants include mineral oils of the type that provoke swelling and aliphatic alcohols of 8 to 13 carbon atoms such as tridecyl alcohol, with a preferred seal swellant being characterized as an oil-soluble, saturated, aliphatic or aromatic hydrocarbon ester of from 10 to 60 carbon atoms and 2 to 4 ester linkages, e.g., dihexylphthalate, as are described in U.S. Pat. No. 3,974,081.

ATF compositions containing these conventional additives are typically blended into the mineral oil base in the following ranges thereby providing their normal attendant function.

| Components | Vol % | Wt % |
|---|---|---|
| V.I. Improver | 1–15 | 1–16 |
| Corrosion Inhibitor | 0.01–1 | .01–1.5 |
| Oxidation Inhibitor | 0.01–1 | .01–1.5 |
| Dispersant | 0.5–10 | 0.5–11 |
| Pour Point Depressant | 0.01–1 | .01–1.5 |
| Demulsifier | 0.001–0.1 | .001–0.15 |
| Anti-Foaming Agents | 0.001–0.1 | .001–0.15 |
| Anti-Wear Agents | 0.001–1 | .001–1.5 |
| Seal Swellant | 0.1–5 | 0.1–6 |
| Friction Modifiers | 0.01–1 | .01–1.5 |
| Mineral Oil Base | Balance | Balance |

In a broad sense therefore, the dual additive combination of the present invention is employed in a lubricating oil composition comprising a major amount of a lubricating oil and a minor amount of the combination of Components A and B effective to impart one or more of the properties described herein. Additional conventional additives selected to meet the particular requirements of a selected type of lubricating oil composition can be included as desired.

Components A and B can be incorporated into the lubricating oil in any convenient way. Thus, each component can be added directly to the oil by dissolving the desired component in the oil at the desired level of concentration. Alternatively, each component may be blended separately with a suitable solvent to form concentrates, and then blending these concentrates with lubricating oil base stock to obtain the compositions of this invention. It is not recommended to mix Components A and B in a single concentrate. A typical concentrate will have a concentration of about 30 to about 60%, by weight of each additive in a suitable solvent, which may be the base oil itself or a solvent which is miscible with the base lubricating oil. The concentration of additive in the concentrate is not critical.

Suitable solvents which can be used for this purpose are naphtha, kerosene, xylene, toluene, light mineral oil, heavy gas oils, and mixtures thereof.

The particular solvent selected should, of course, be selected so as not to adversely affect the other desired properties of the ultimate oil composition.

When other additives are employed, it may be desirable, although not necessary, to prepare additive concentrates comprising concentrated solutions of Components A and B together with said other additives whereby the several additives are added simultaneously. Dissolution of the additive concentrate into the lubricating oil is facilitated by mixing accompanied with mild heating.

The following examples are given as specific illustrations of the claim invention. It should be understood, however, that the invention is not limited to the specific details set forth in the examples. All parts and percentages in the examples as well as in the remainder of the specification are by weight unless otherwise specified.

EXAMPLE 1

A fully formulated automatic transmission fluid referred to herein as Base Oil A was obtained containing a mineral lubricating oil having a viscosity of 4 to 9 CST at 100° C. Base Oil A contained 1.2 wt% of a styrene-maleic anhydride interpolymer ester (Component A-ii), based on the weight of Base Oil A. This interpolymer ester was prepared in accordance with the procedure whereby styrene and maleic anhydride (1:1 molar) are reacted to form an intermediate interpolymer having a number average molecular weight of 40,000. Ninety-five percent of the carboxyl groups of the polymer are then esterified with a commerical mixture of $C_{12}$ to $C_{18}$ primary alkanols followed by neutralization of the remaining unesterified carboxyl radicals with N-aminopropylmorpholine. In addition, Base Oil A also contained 0.025 wt% of an esterfied interpolymer of (a) a mixture of $C_{14}$ to $C_{24}$ and higher olefins and (b) maleic anhydride wherein the carboxyl groups thereof were subsequently fully esterified with a $C_{10}$ to $C_{20}$ mixture of primary alcohols. This copolymer is a conventional lube oil pour point depressant, referred to herein as O/MA copolymer.

EXAMPLE 2

A fully formulated automatic transmission fluid, referred to herein as Base Oil B, was obtained as in Example 1 with the exception that the styrene-maleic anhydride interpolymer ester was replaced with a poly methacrylate (Component A-i) derived from the reaction of about 3.5 wt% of dimethylaminopropylmethacrylamide, based on the total weight of monomers in the reaction mixture, interpolymerized with about a 96.5 wt% mixture of methacrylates wherein the alcohol residues thereof are derived primarily from a mixture of primary $C_{12}$ to $C_{18}$ alcohols characterized by the following carbon number distribution on a wt% basis:

$C_{12}$—23%
$C_{13}$—29%
$C_{14}$—28%
$C_{15}$—19%
$C_{16}$—1%
$C_{18}$—0.5%

EXAMPLE 3

Base Oils A and B were then employed as reference oils for the evaluation of the low temperature viscosity properties thereof and the effect on these preparation of incorporating different Component B compounds.

Accordingly, the Brookfield viscosity (cps) at −40° C. of 50 g of Base Oils A was tested and the results summarized at Table 1, Run 1. To different samples of this base oil was added 0.1% of a single Component B additive identified in Table 1, Runs 2 to 11. The Brookfield viscosity at −40° C. of the additive containing oil samples were tested and the results summarized at Table 1, Runs 2 to 11.

The above procedure was repeated with Base Oil B using the additives shown at Table 1, Runs 12 to 16. The Brookfield viscosity at −40° C. of the Base Oil B is recorded at Run 12, while the viscosity of the Base Oil B under the same conditions in the presence of each Component B additive is summarized at Runs 13 to 16.

COMPARATIVE EXAMPLE 1

This comparative example illustrates the effect adding additional amounts of a conventional lube oil pour point depressant instead of a Component B compound.

The first lube oil pour point depressant tested was a vinyl acetate $C_6$ to $C_{18}$ dialkyl fumarate interpolymer having a number average molecular weight of 6,000 and referred to herein as VA/DAF-1. The second viscosity index improver tested was a vinyl acetate $C_{10}$ to $C_{18}$ dialkyl fumarate interpolymer having a number average molecular weight of 6,000, and referred to herein as VA/DAF-2.

Accordingly, VA/DAF-1 was added to Base Oils A and B at 0.2 wt% concentration, based on the weight of Base Oil, the viscosity tested, and the results summarized at Table 1, Runs 17 and 18.

The VA/DAF-2 copolymer was added to Base Oil A at a 0.2 wt% concentration, based on the weight of Base Oil, the viscosity tested, and the results summarized at Table 1, Run 19.

COMPARATIVE EXAMPLE 2

Base Oil A was mixed with 0.1 wt% polypropylene glycol behenic acid ester, wherein the polyoxypropylene moiety has a number average molecular weight of 1,025. The viscosity of the resulting composition was tested and the results summarized at Table 1, Run 20.

This comparative example, illustrates that when the alkyl portion of the polyoxyalkylene fatty acid ester of Component B, exceeds two carbons, the viscosity goes up instead of down.

TABLE 1

| Run No. | Base Oil Type | Components B** Additive to Base Oil | Brookfield Viscosity (cps) at −40° C. |
|---|---|---|---|
| 1 | A | O | *49,250 |
| 2 | A | Sorbitan Monopalmitate | 45,000 |
| 3 | A | Sorbitan Tristearate | 46,000 |
| 4 | A | PEG (10) Octadecyl Ether | 47,000 |
| 5 | A | PEG (20) Sorbitan Tristearate | 46,700 |
| 6 | A | PEG (14) Dibehenate | 49,000 |
| 7 | A | PEG (5)(10)(14) Behenate/Stearate | 47,000 |
| 8 | A | PEG (5) Distearate | 46,000 |
| 9 | A | PEG (14) Distearate | 47,000 |
| 10 | A | PEG (20) Sorbitan Dibehenate/ Tribehenate | 49,000 |
| 11 | A | PEG (5)(10)(14) Dibehenate | 46,300 |
| 12 | B | O | *48,750 |
| 13 | B | PEG (5)(10)(14) Dibehenate | 46,500 |
| 14 | B | Sorbitan Monopalmitate | 44,000 |
| 15 | B | PEG (20) Sorbitan Tristearate | 47,500 |
| 16 | B | Sorbitan Tristearate | 39,000 |
| | | Alternate Additive | |
| 17 | A | VA/DAF-1 | 51,000 |
| 18 | B | VA/DAF-1 | 50,000 |
| 19 | A | VA/DAF-2 | 50,800 |
| 20 | A | PPG (18) Behenate | *71,000 |

*Average value
**The number in parenthesis represents the number of repeating oxyethylene or oxypropylene units in molecule. All mixtures of PEG oligomer units contain equal molar amounts of each oligomer in the mixture. Also when more than one fatty acid is reported, each fatty employed in equal molar amounts.
PPG = polypropylene glycol

DISCUSSION OF RESULTS

Referring to Table 1, it will be observed that Component B can produce a viscosity drop of up to 4,000 cps for Base Oil A and up to 10,000 cps for Base Oil B. In both instances, the largest viscosity drop is caused by sorbitan tristearate.

Comparative Runs 17 and 19 illustrate the effect of adding additional amounts of a conventional lube oil pour point depressant to Base Oil A in place of Component B type compounds, namely, the low temperature viscosity goes up instead of down. It is concluded from this data that the viscosity improving agent with pour point depressant activity, i.e., the styrene/maleic anhydride esterified interpolymer, and the conventional lube oil pour point depressant O/MA esterified interpolymer, present in Base Oil A, have exhausted the wax crystal interactive effect, and adding an additional lube oil pour point depressant made this effect occur faster, buth with less efficiency. Similar considerations apply to Run 18.

The principles, preferred embodiments, and modes of operation of the present invention have been described in the foregoing specification. The invention which is intended to be protected herein, however, is not to be construed as limited to the particular forms disclosed, since there are to be regarded as illustrative rather than restrictive. Variations and changes may be made by those skilled in the art without departing from the spirit of the invention.

What is claimed is:

1. A lubricating oil composition comprising a major amount of a mineral oil of lubricating viscosity and a minor amount of a dual additive combination comprising Components (A) and (B) effective to lower the viscosity of said composition at temperatures between about −20° and −40° C. relative to the absence of either of Components (A) or (B), wherein:

(1) Component A comprises of at least one member selected from the group consisting of:

(i) a polymeric product characterized by a number average molecular weight of from about 25,000 to about 70,000 and of the type derived from the random polymerization of a reaction mixture comprised of at least 90 mole % of at least one ester monomer represented by the structural formula:

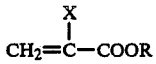

(I)

wherein X can represent hydrogen or methyl, and R represents an aliphatic hydrocarbyl group containing from about 1 to about 24 carbon atoms, with the proviso that the average number of carbon atoms in the hydrocarbyl group constituting R within said polymeric product is from about 8 to about 18; and (ii) an esterified polymeric product derived from the esterification of an interpolymer of the type derived from the reaction of a monomer mixture consisting essentially of (a) styrene and (b) a carboxyl containing monomer anhydride represented by the structural formula:

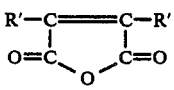

(II)

wherein each R′ independently can represent hydrogen or methyl; with the molar ratio of styrene to carboxyl containing monomer in said reaction mixture being from about 3:1 to about 1:1 and said unesterified interpolymer being characterized by a number average molecular weight of from about 25,000 to about 70,000; said esterification being characterized by that resulting from the reaction of at least 50 mole % of the carboxyl groups present on said unesterified interpolymer with a reaction mixture comprised of at least one aliphatic monohydric alcohol containing from about 1 to about 24 carbon atoms; and (2) Component B comprises at least one member selected from the group consisting of:

(i) sorbitan monoesters, sorbitan diesters, sorbitan triesters, and mixtures thereof, which esters are derived from $C_{10}$ to $C_{30}$ straight chain saturated fatty acids;

(ii) polyoxymethylene or polyoxyethylene: esters, ethers or ether/alcohols, or ester/ether mixtures, derived from $C_{10}$ to $C_{30}$ straight chain saturated fatty acids, $C_{10}$ to $C_{30}$ saturated aliphatic alcohols, or mixtures of said fatty acids or alcohols, respectively; said polyoxymethylene segments thereof having a number average molecular weight of from about 80 to about 4,000, and said polyoxyethylene segments thereof having a number average molecular weight of from about 100 to about 5,000; and (iii) polyoxymethylene or polyoxyethylene ethers of sorbitan monoesters, sorbitan diesters, sorbitan triesters or mixtures thereof, said sorbitan esters being derived from $C_{10}$ to $C_{30}$ straight chain saturated fatty acids, and said polyoxymethylene and polyoxyethylene segments thereof having number average molecular weights as described in connection with Component B-ii.

2. The lubricating oil composition of claim 1 wherein Component A is a polymethacrylate.

3. The lubricating oil composition of claim 2 wherein the polymethacrylate is derived from a mixture of about $C_8$ to $C_{18}$ straight chain saturated alkyl monohydric primary alcohols.

4. The lubricating oil composition of claim 3 wherein the polymethacrylate is derived from a mixture of about $C_{12}$ to $C_{15}$ straight chain alkyl monohydric primary alcohols.

5. The lubricating oil composition of claim 1 wherein Component A is derived from an interpolymer of styrene and maleic anhydride.

6. The lubricating oil composition of claim 5 wherein in said interpolymer from about 75 to about 100 mole % of the carboxyl groups initially present therein are esterified with a mixture of about $C_1$ to about $C_{24}$ straight chain saturated alkyl monohydric alcohols.

7. The lubricating ol composition of claim 6 wherein the molar proportion of $C_3$ to $C_5$ alcohols to $C_8$ to $C_{24}$ alcohols in said mixture is from about 1:2.3 to about 1:9.

8. The lubricating oil composition of claim 1 wherein Component B comprises PEG (5) dibehenate, PEG (10) dibehenate, PEG (14) debehenate and mixtures thereof.

9. The lubricating oil composition of claim 1 wherein Component B comprises sorbitan tristearate.

10. The lubricating oil composition of any one of claims 2 to 4 or 5 to 7 wherein Component B is sorbitan tristearate.

11. The lubricating oil composition of any one of claims 2 to 4 5 to 7 wherein Component B is a mixture of PEG (5) dibehenate, PEG (10) dibehenate, and PEG (14) dibenehate.

12. The lubricating oil composition of claim 1 adapted for use as an automatic transmission fluid further comprising a Viscosity Index improver, a dispersant, and a friction modifier.

* * * * *